United States Patent [19]

Guy et al.

[11] Patent Number: 4,648,752

[45] Date of Patent: Mar. 10, 1987

[54] MARINE TEMPLATE RETAINING WALL AND METHOD OF CONSTRUCTION

[75] Inventors: Arthur L. Guy; Maynard S. Glasscock, both of Houston, Tex.

[73] Assignee: Exxon Production Research Co., Houston, Tex.

[21] Appl. No.: 770,441

[22] Filed: Aug. 29, 1985

[51] Int. Cl.[4] ..... E02B 17/02

[52] U.S. Cl. ..... 405/217; 405/227; 405/277; 405/14

[58] Field of Search ..... 405/11, 12, 13, 14, 405/61, 217, 227, 274, 276, 277, 278, 281

[56] References Cited

U.S. PATENT DOCUMENTS

| | | | |
|---|---|---|---|
| 965,157 | 7/1910 | Conkling | 405/278 |
| 1,827,146 | 10/1931 | Gruppe | 405/14 |
| 2,018,446 | 10/1935 | Jensen | 405/280 |
| 2,073,545 | 3/1937 | Atkinson | 405/14 |
| 2,968,931 | 1/1961 | McGrath | 405/276 |
| 3,483,708 | 12/1969 | Marshall | 405/227 |
| 3,512,811 | 5/1970 | Bardgette et al. | 405/227 |
| 3,895,471 | 7/1975 | Kolb | 405/227 |
| 4,055,052 | 10/1977 | Metge | 405/217 |
| 4,187,039 | 2/1980 | Jahns et al. | 405/217 |
| 4,265,569 | 5/1981 | Gefuert | 405/61 |
| 4,325,656 | 4/1982 | Bishop | 405/11 |
| 4,386,872 | 7/1983 | Smith | 405/13 |
| 4,456,072 | 6/1984 | Bishop | 405/217 |
| 4,575,281 | 3/1986 | Oksuzler | 405/217 |
| 4,585,678 | 4/1986 | Kunito | 405/276 |

*Primary Examiner*—Richard J. Scanlan, Jr.
*Attorney, Agent, or Firm*—John S. Schneider

[57] ABSTRACT

A template retaining wall for use in marine environments is composed of a plurality of interconnected, piled, prefabricated templates. Each template comprises a series of vertically extending, horizontally spaced apart legs and a series of battered, horizontally spaced apart legs. The legs are interconnected by horizontally and diagonally extending truss/strut members. A track guide is positioned on one lateral end of each template and a rider guide is positioned on the other lateral end of each template. The rider guide on one template engages the track on an adjacent template. A metal sheet pile is welded between each of the vertical legs and piles, extend through each of the legs into the ground underlying the water. The retaining wall may be curved into a circular configuration to enclose and retain an artificial island or may be formed into other shapes.

3 Claims, 16 Drawing Figures

MARINE TEMPLATE RETAINING WALL AND METHOD OF CONSTRUCTION

BACKGROUND OF THE INVENTION

Field of the Invention

This invention relates generally to marine retaining walls. More specifically, the invention concerns caissons for retaining artificial islands used in offshore drilling and production operations and their method of construction. The caissons of this invention have broad application for artificial island construction in the Arctic and in many other environments.

The main problems encountered in constructing a caisson (sheet or sheet piling) retained Arctic gravel island for drilling and production operations are: (1) elaborate construction aids would need to be created to handle and efficiently emplace the long slender sheets in 40 feet and greater water depths, (2) more accurate pile alignment would be necessary than is normal offshore—any misalignment would be difficult and time consuming to correct, and (3) failure to complete the construction in the summer season would result in severe ice damage—some bulkhead design concepts involve driving 600 sheet piles.

SUMMARY OF THE INVENTION

The marine retaining wall of the present invention comprises a plurality of interconnected piled templates. Each template comprises a series of vertically extending, horizontally spaced apart legs and a series of battered, horizontally spaced apart legs. These legs are interconnected by horizontally and diagonally extending brace support members. The battered legs cause the cross-section of each template to increase from top to bottom. A track guide is positioned on one lateral end of each template and a rider guide is positioned on the other lateral end of each template. The rider guide in one template engages the track in an adjacent template. A sheet or sheet piling is attached to and extends across the front of each of the templates. Piles extend through each of the vertical and battered legs into the ground underlying the water. The interconnected templates may be formed into a circular enclosure in plan view, as shown and described herein, to form a caisson to retain an artificial island, or may be formed into other shapes in plan view.

In constructing the retaining wall for an artificial island, the construction site is first prepared by leveling the sea floor in the area where the templates are to be placed. Each template is then lifted by a crane and lowered into position. The edge of each template is set in line with the opposite edge of the previously installed template and is positioned such that the guides are in line. That is, the rider on the template being installed is inserted into the track of the previously installed template. The template is then guided slowly downwardly on the track guide until the template is just above the mudline. Then the template is pivoted about the guides until the free edge of the template is the correct distance from a reference pile as measured using a reference cable or other known accurate surveying method. The template is then set and piles are driven through the vertical and battered legs of the template. Then, each additional template is put into position similarly until the caisson has been completed. Once enough templates are in position and a sufficient number of piles have been driven to ensure integrity of the existing partial caisson structure, the introduction of fill material may commence or introduction of the fill material may await completion of the caisson.

Each template has a significant length of retaining wall in order to reduce greatly the amount of pile driving per unit length of perimeter of the caisson. This structure contains several features which make it attractive for use in constructing marine retaining walls. They include: the templates can be entirely constructed offsite onshore; a minimal amount of pile driving is required in placing the templates; and no tie-backs or similar additional anchoring devices are required.

Each of these features allows offshore installation time to be kept at a minimum. This is a major advantage of this type of installation since a retained artificial island would ordinarily be constructed in the Arctic during the very short open water summer season.

DESCRIPTION OF THE PREFERRED EMBODIMENTS

Figure 1:
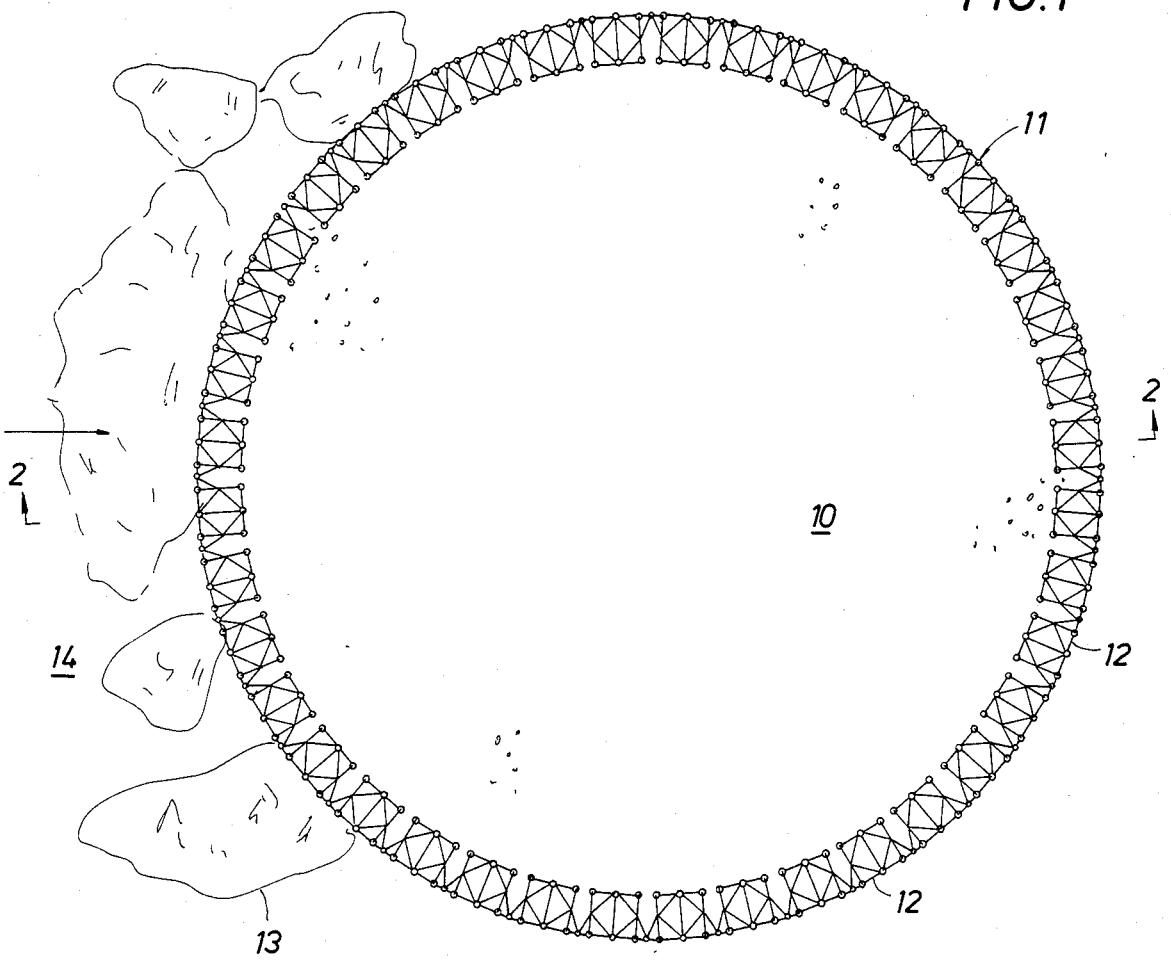
FIG. 1 is a plan view of a template caisson constructed in accordance with the invention.

In FIG. 1 there is shown an artificial island 10 surrounded and retained by a circular caisson 11 formed of a number of individual interconnected templates 12. A few ice floes 13, shown floating in water 14, are in contact with the outer surface of caisson 11.

Figure 2:
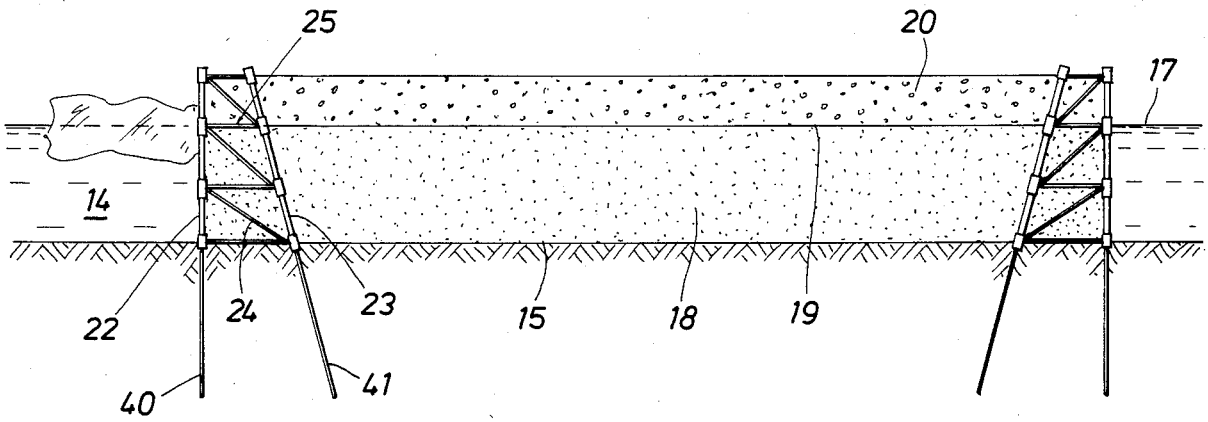
FIG. 2 is a sectional view taken on line 2—2 of FIG. 1.
Figure 4:
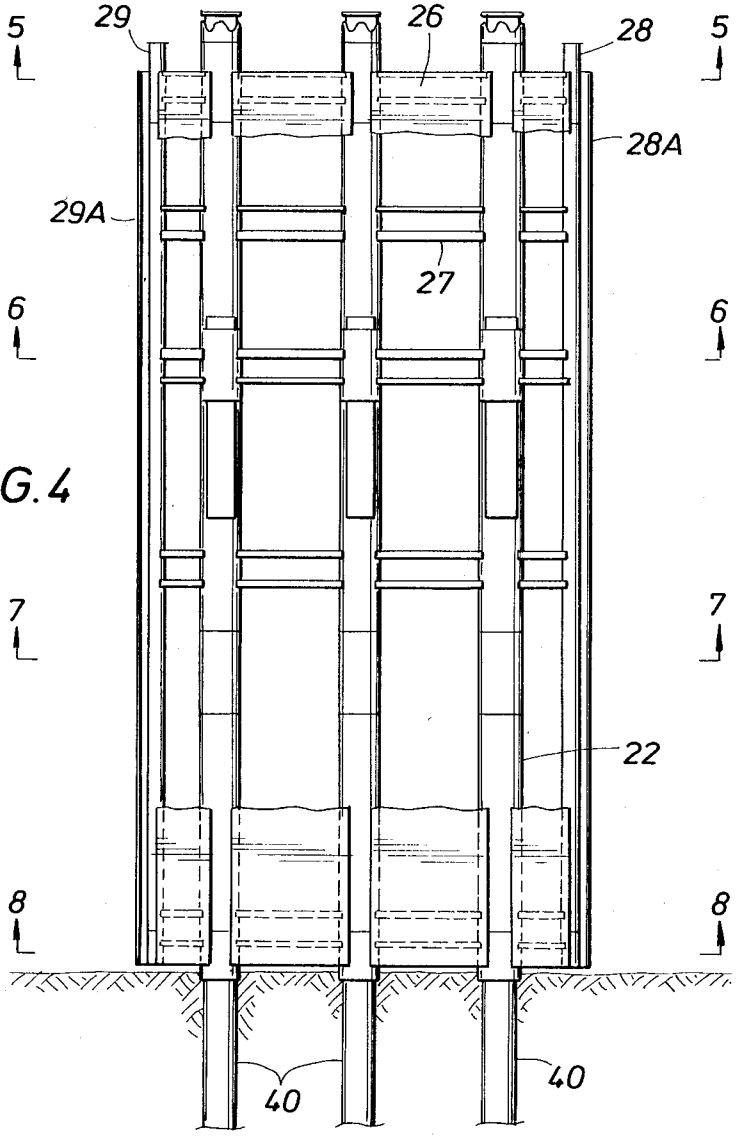
FIG. 4 is a view taken on line 4—4 of FIG. 3.
Figure 3:
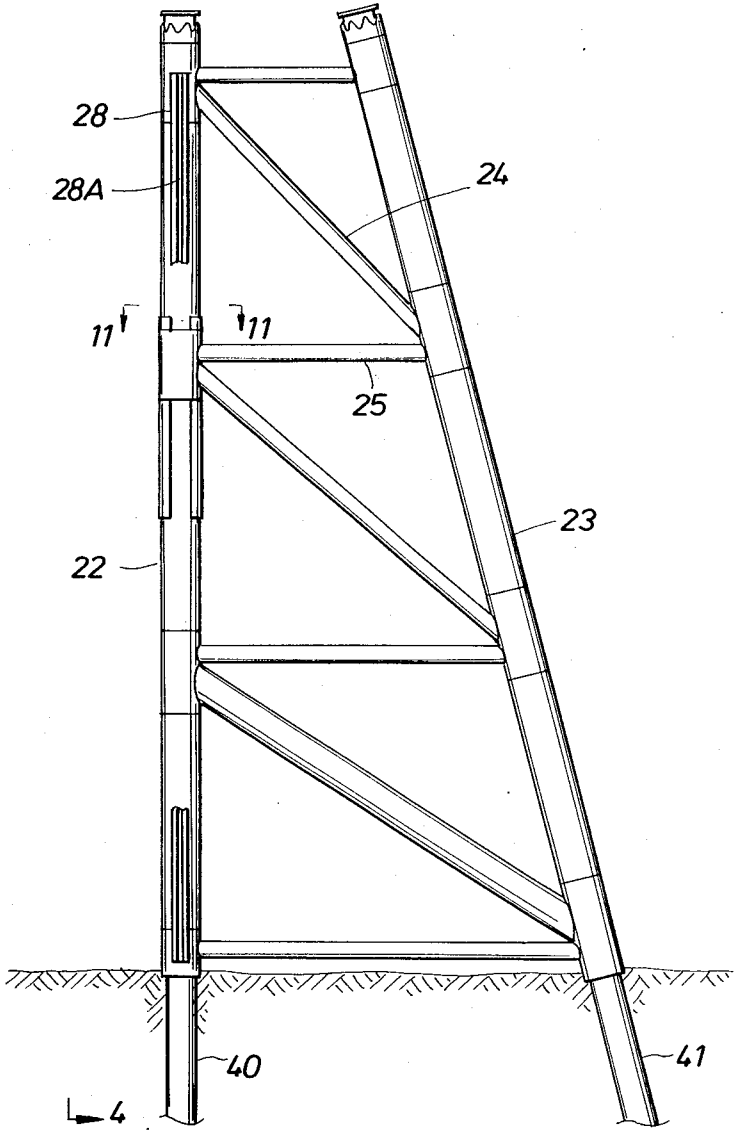
FIG. 3 is a side elevation of one of the templates of the caisson.
Figure 5:
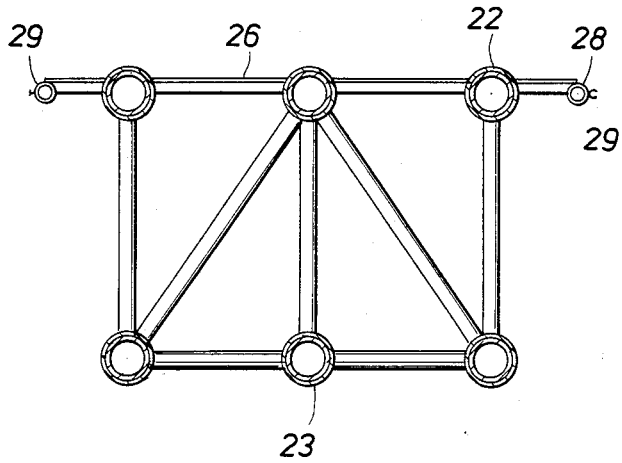
FIG. 5 is a view taken on line 5—5 of FIG. 4.
Figure 6:
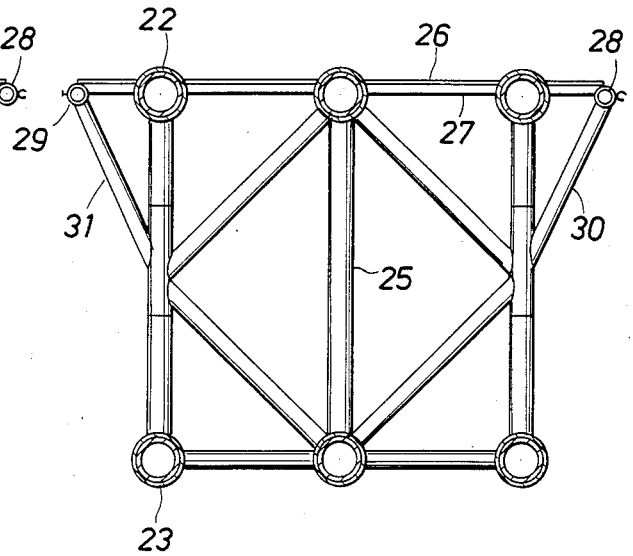
FIG. 6 is a view taken on line 6—6 of FIG. 4.
Figure 7:
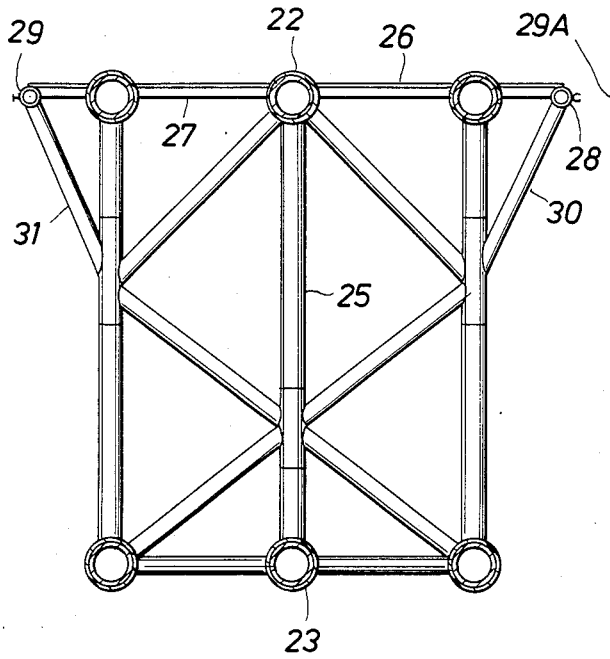
FIG. 7 is a view taken on line 7—7 of FIG. 4.
Figure 8:
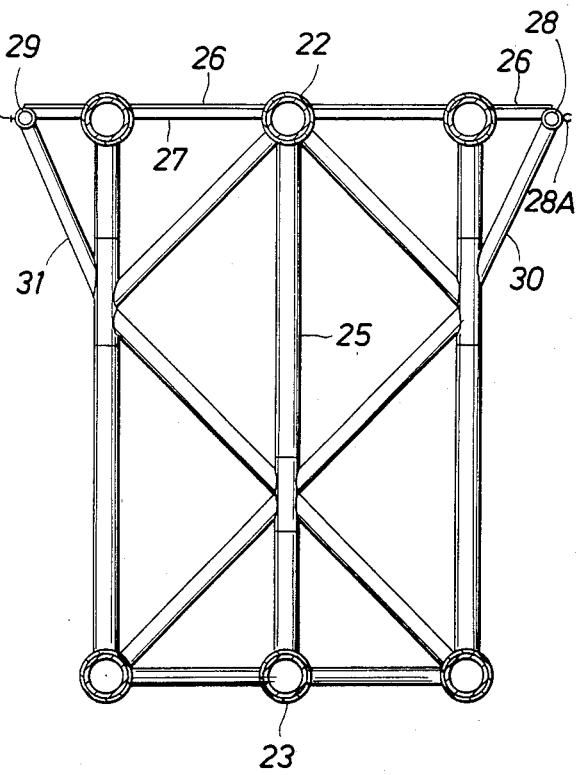
FIG. 8 is a view taken on line 8—8 of FIG. 4.

The individual template 12 is shown in more detail in FIG. 2 and in FIGS. 3 through 8.

The lower ends of template 12 rest on the mudline 15 below the body of water 14. The upper end of each template extends above the mean water level 17 of water 14. The artificial island is composed of a layer of silty sand fill 18 on top of which is a fabric membrane 19 and on top of that is a gravel fill 20.

Each template is formed of three vertical front legs 22 and three battered or slanted back legs 23 connected together by truss work which includes diagonal bracing or struts 24 and horizontal bracing or struts 25. As seen in FIGS. 5 through 8, in particular, the cross-section of the template decreases from bottom to top as a result of battered legs 23. A steel sheet 26 is welded between each of the vertical legs 22 and to support members 27 which are also welded to and between each of the vertical legs 22. Guide supports 28 and 29 are supported by additional bracing 30 and 31, respectively, and to additional steel sheets 26 extending between the vertical leg 22 adjacent to it, and guide support 28 or 29. A track type guide support 28A is connected to guide support 28 and a "T" shaped guide runner 29A is attached to guide support 29. Piles 40 extend through vertical legs 22 and piles 41 extend through battered legs 23.

Figure 9:
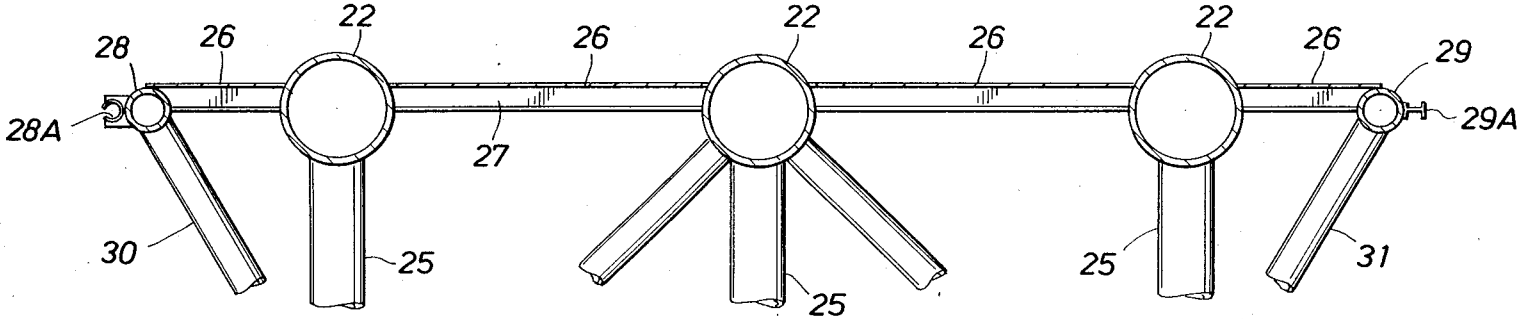
FIG. 9 is an enlarged plan view of the front wall of one of the templates.
Figure 10:
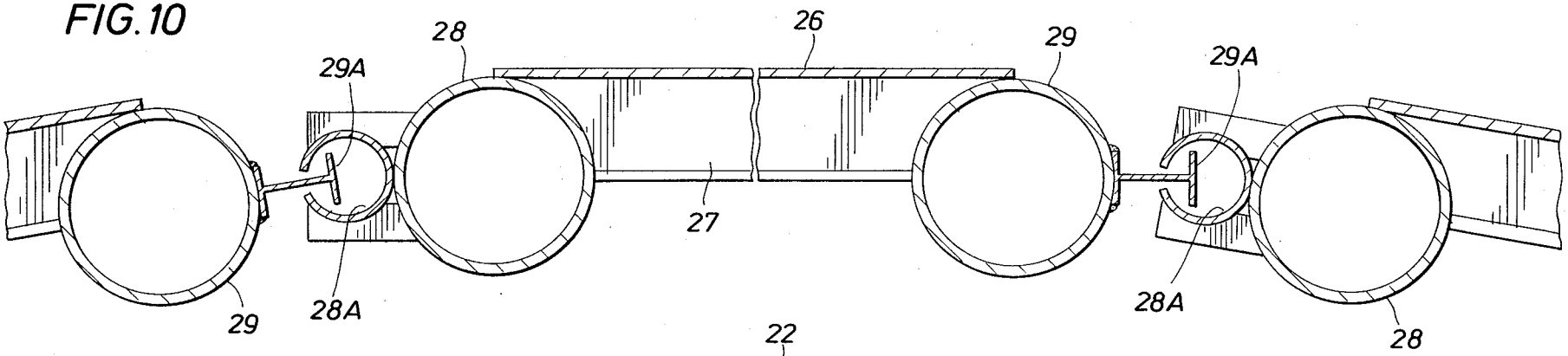
FIG. 10 is another enlarged plan view of the front wall of one of the templates and its connections to adjacent templates.

The track 28A and T-rider 29A and the associated bracing and truss work and vertical legs 22 are shown enlarged and in more detail in FIGS. 9 and 10.

Figure 11:
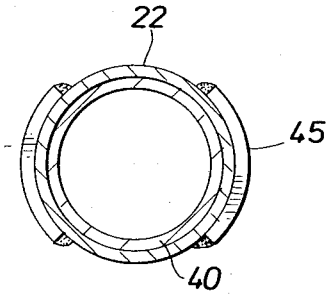
FIG. 11 is a view taken on line 11—11 of FIG. 3.

FIG. 11 shows the semi-circular segments or sections 45 welded to vertical leg 22 upon which the collar member 46 is welded. The horizontal bracing 25 and diagonal bracing 24 connect to collar sections 45.

Figure 13:
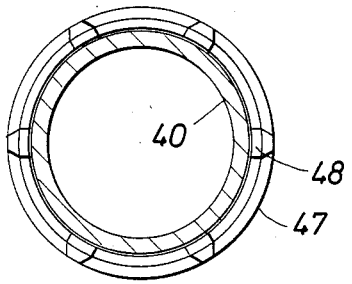
FIG. 13 is a view taken on line 13—13 of FIG. 12.
Figure 12:
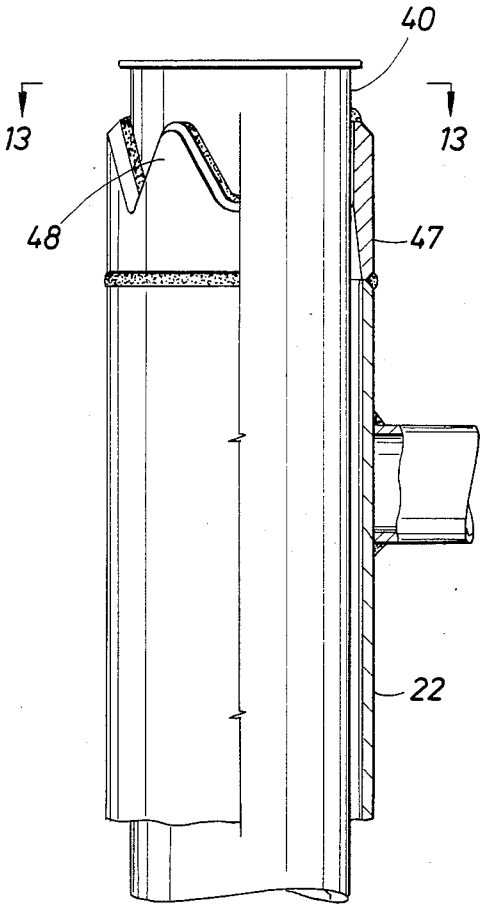
FIG. 12 is a side elevation of a part of a template leg and a pile extending therethru.

In FIGS. 12 and 13 there is shown a template leg crown 47 welded to the upper end of template leg 22 (or 23). The upper end of crown 47 has an undulating surface with raised portions 48. The undulations provide more surface welding area for the connection to pile 40 (and pile 41).

Figure 14:
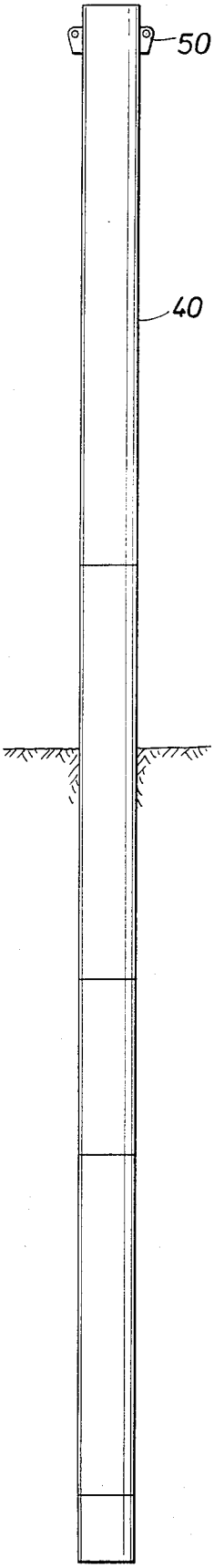
FIG. 14 is a side elevation of a pile.
Figure 15:
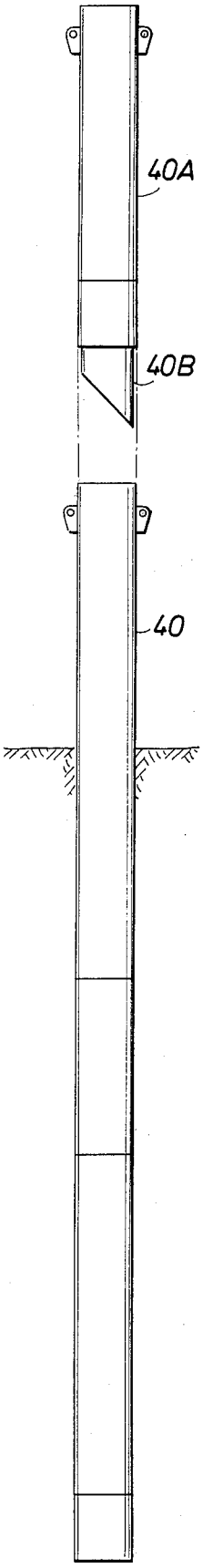
FIG. 15 is a similar side elevation of a pile showing a section of pile being added.

In FIG. 14 is illustrated pile 40 which extends through template leg 22. Pile 40 has a lifting eye 50 for placing the pile in position and retaining each pile section as it is driven into the ground underlying the water. In FIG. 15, there is shown a similar view of pile 40 in which a section of pile 40A provided with a stabbing guide portion 40B at its lower end is being placed into a lower already-driven section of pile 40.

Figure 16:
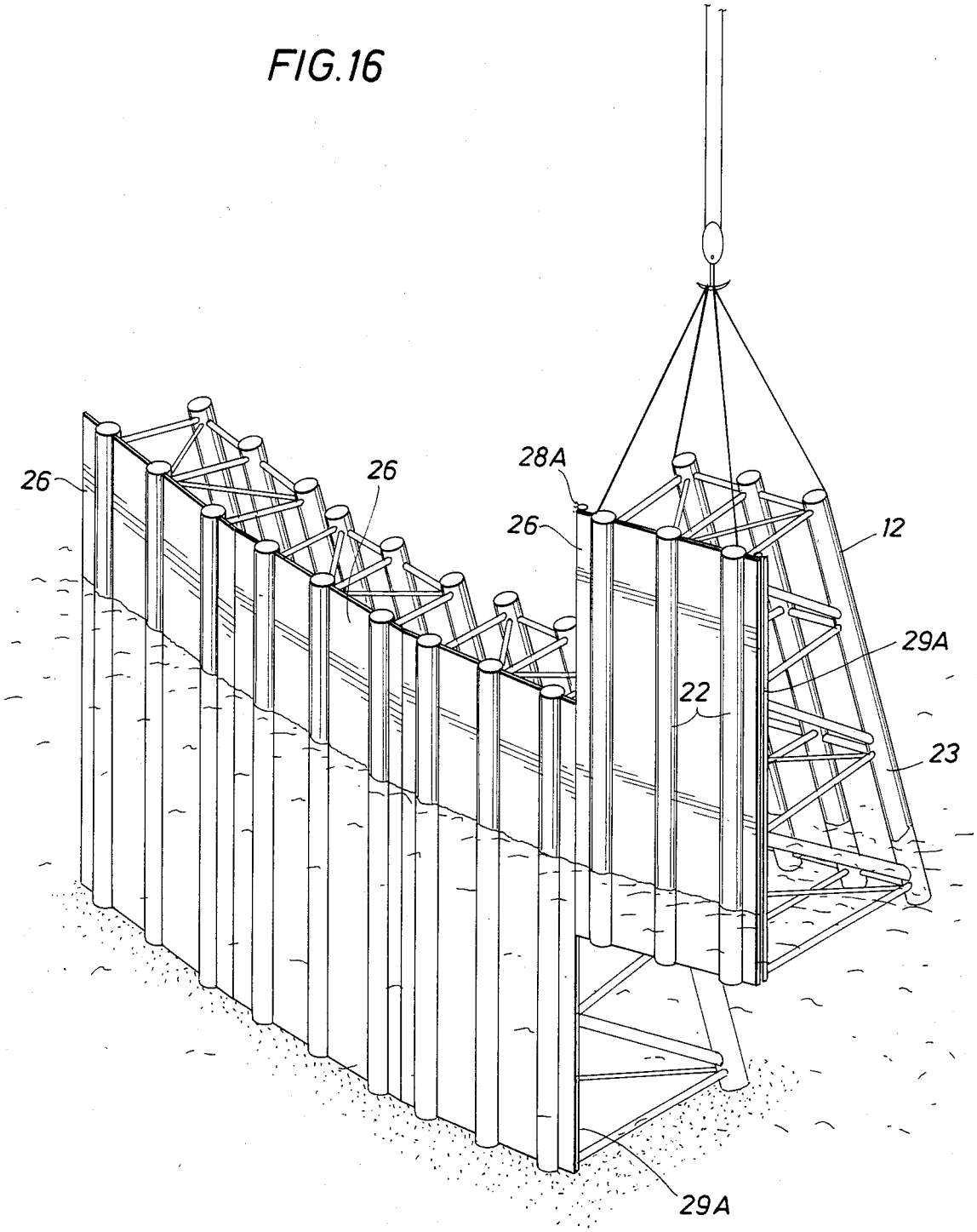
FIG. 16 is a view of a portion of the caisson and illustrates lowering a template into place in constructing the caisson.

FIG. 16 shows a template 12 being lowered into place. The template is oriented just before being placed into position by rotating it to be in alignment with the other templates.

While the preferred embodiment discloses and describes each template as having three vertical legs and three battered legs, other designs having more or less than three vertical legs and more or less than three battered legs may be used. Further, the sheets or sheet piles may be made of material other than steel, such as aluminum or plastic material. Also, the sheets may be corrugated rather than flat and the wall itself can be any desired shape—straight, undulated, curved, circular, square etc. In addition, the artificial island fill material may be varied depending upon location. For example, the fill material may be all sand or all gravel, or mixtures thereof.

Other possible variations in the retaining wall and artificial island shown and described herein include: the retaining wall may be segmented; different connecting and alignment devices may be used between segments; other space frame geometries for optimum use of the piles may be employed; other wall designs may be used for withstanding lateral loads; different wall designs for enhancing emplacement and removal of the structure may be employed; fabricated components may be repeated; the templates may be fabricated off-site; the templates may have common structural shape and tubular structure; skirts may be added to the sheet wall to reduce scour and improve lateral stability; mudmat-type footings may be added to help retain fill (counterfort walls); and wave barriers may be added to the top of the structure.

As seen, there are many ways that the basic concept may be modified to highlight one feature or another. However, two important basic features are: (1) the space frame concept of tubulars or structural shapes used to individually support retaining wall segments and (2) connective devices to allow integration of individual wall segments into a marine retaining wall. That wall may be a whole island perimeter of a circular or other shape with dimensions which can be easily varied to suit drilling and production requirements.

Modifications and changes may be made in the apparatus and method described herein without departing from the spirit and scope of the invention as defined in the appended claims.

We claim as our invention:

1. A marine retaining wall comprising:

a plurality of interconnected templates, each template comprising a series of vertically extending spaced apart legs and a series of battered spaced apart legs providing a cross-section for each template that increases from top to bottom;

diagonally and horizontally extending brace support members interconnecting said vertical and battered legs of each template;

a tract guide on one lateral end of each template;

a rider guide on the other lateral end of each template;

said rider guide engaging said tract guide on adjacent templates;

sheet means connected to said vertical legs forming a continuing wall across each template;

piles extending through said vertical and battered legs into the ground underlying the water; and said wall comprising an enclosure and fill material within said enclosure to form an artificial island.

2. A wall as recited in claim 1 in which each template comprises three vertical legs and three battered legs.

3. A method for constructing a marine retaining wall comprisng the steps of:

lifting and lowering into position on the sea floor a series of templates, each having a series of vertically extending spaced apart legs and a series of battered spaced apart legs and sheet means connected to said vertical legs forming a continuing wall across each template, the edge of each template being set in line with the opposite edge of a previously installed template and in position such that guides on the template are in line;

in serting a rider guide on the template being installed into a track guide of the previously installed template:

guiding each template slowly downwardly on the tract guide until the template is just above the seafloor;

pivoting the template about the guides until the free edge of the template being installed is a correct predetermined distance from a reference point as measured using any desired proven surveying technique;

setting the template and driving piles through the vertical and battered legs of the template;

putting into position each additional template similarly until the wall has been completed to form an enclosure; and said wall enclosing and retaining fill material to form an artificial island.

* * * * *